US009404658B2

(12) United States Patent
Nickolaus

(10) Patent No.: US 9,404,658 B2
(45) Date of Patent: Aug. 2, 2016

(54) GAS TURBINE ENGINE FUEL AIR MIXER

(71) Applicant: Rolls-Royce Corporation, Indianapolis, IN (US)

(72) Inventor: Daniel Nickolaus, Plainfield, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 273 days.

(21) Appl. No.: 14/105,495

(22) Filed: Dec. 13, 2013

(65) Prior Publication Data

US 2015/0167985 A1 Jun. 18, 2015

Related U.S. Application Data

(60) Provisional application No. 61/772,812, filed on Mar. 5, 2013.

(51) Int. Cl.
*F23R 3/34* (2006.01)
*F23R 3/28* (2006.01)
*F23R 3/14* (2006.01)

(52) U.S. Cl.
CPC . *F23R 3/286* (2013.01); *F23R 3/14* (2013.01); *F23R 3/343* (2013.01); *F23R 2900/03343* (2013.01)

(58) Field of Classification Search
CPC ..... F23R 3/286; F23R 3/12; F23R 3/14; F23R 3/34; F23R 3/343; F23R 2900/03343
USPC ..... 60/733, 734, 737, 739, 740, 742, 746, 60/747, 748, 776
See application file for complete search history.

(56) References Cited

U.S. PATENT DOCUMENTS 5,062,792 A * 11/1991 Maghon ..... F23C 7/004 239/400
6,199,367 B1 * 3/2001 Howell ..... F23D 11/24 239/402.5
6,363,726 B1 * 4/2002 Durbin ..... F23R 3/343 60/748
6,405,523 B1 6/2002 Foust et al.
6,571,559 B1 6/2003 Fortuna et al.
6,865,889 B2 3/2005 Mancini et al.
6,968,692 B2 11/2005 Chin et al.

(Continued)

FOREIGN PATENT DOCUMENTS

EP 1391652 A2 2/2004

OTHER PUBLICATIONS

International Search Report PCT/US2013/067769 mailed on Jul. 25, 2014.

*Primary Examiner* — Steven Sutherland
(74) *Attorney, Agent, or Firm* — Fishman Stewart PLLC

(57) ABSTRACT

A gas turbine engine device is disclosed for mixing fuel and air prior to a combustion. The device includes a pilot mixer and a main mixer each having a fuel opening for the delivery of fuel to one or more passages. In one form the main mixer includes an inner passage and an outer passage and in which a fuel opening delivers fuel to the inner passage. The main mixer can include swirlers in the inner and/or outer passages. The pilot mixer can also include a swirler. In one embodiment the main mixer includes a converging flow path and/or a diverging flow path. The pilot mixer can also include a converging and/or diverging flow path and in one form is sheltered from an exit of the device. The main mixer fuel opening can be disposed between an upstream end and a downstream end of the mixer.

16 Claims, 3 Drawing Sheets

(56) References Cited

U.S. PATENT DOCUMENTS

| | | | | |
|---|---|---|---|---|
| 7,007,479 | B2 | 3/2006 | Held et al. | |
| 7,266,945 | B2 * | 9/2007 | Sanders | F23D 11/101 60/743 |
| 7,334,410 | B2 | 2/2008 | Creighton et al. | |
| 2005/0130089 | A1 | 6/2005 | Oda et al. | |
| 2009/0113893 | A1 | 5/2009 | Li et al. | |
| 2010/0269506 | A1 * | 10/2010 | Nonaka | F23D 11/386 60/742 |
| 2010/0275605 | A1 * | 11/2010 | Hase | F23R 3/343 60/748 |
| 2010/0308135 | A1 | 12/2010 | Yamamoto et al. | |
| 2012/0198850 | A1 * | 8/2012 | Chin | F23R 3/28 60/738 |

* cited by examiner

GAS TURBINE ENGINE FUEL AIR MIXER

CROSS-REFERENCE TO RELATED APPLICATIONS

This application claims priority to U.S. Provisional Patent Application No. 61/772,812 filed Mar. 5, 2013, the contents of which are hereby incorporated in their entirety.

GOVERNMENT RIGHTS

The present application was made with the United States government support under Contract No. NNCO8CB09C, awarded by the National Aeronautics and Space Administration. The United States government has certain rights in the present application.

TECHNICAL FIELD

The present invention generally relates to devices for delivering fuel, and more particularly, but not exclusively, to fuel mixers for gas turbine engines.

BACKGROUND

Providing a fuel/air mixture to a combustor of an internal combustion engine remains an area of interest. Some existing systems have various shortcomings relative to certain applications. Accordingly, there remains a need for further contributions in this area of technology.

SUMMARY

One embodiment of the present invention is a unique fuel mixer. Other embodiments include apparatuses, systems, devices, hardware, methods, and combinations for mixing fuel and air. Further embodiments, forms, features, aspects, benefits, and advantages of the present application shall become apparent from the description and figures provided herewith.

DETAILED DESCRIPTION

Figure 1:
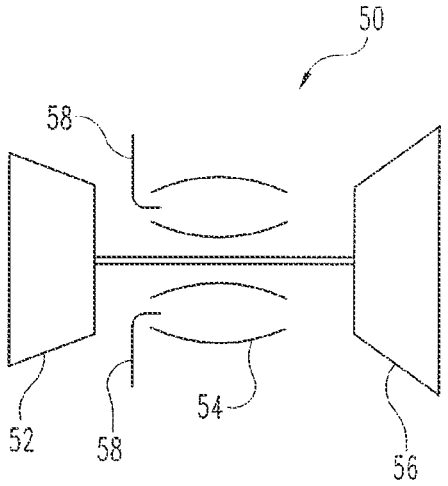
FIG. 1 depicts one embodiment of a gas turbine engine.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

With reference to FIG. 1, a gas turbine engine 50 is disclosed that includes a compressor 52, combustor 54, and turbine 56. As air enters the gas turbine engine it is compressed by the compressor 52 and mixed with a fuel provided by a fuel mixer 58. The fuel mixer 58 can be located a variety of places within the gas turbine engine and is not limited to the location depicted in FIG. 1. The fuel/air mixture is combusted in the combustor 54 before being delivered to the turbine 56. As used herein, the term "air" refers to any oxidizer suitable for use with a fuel that is to be combusted in the combustor 54, whether or not the oxidizer takes the form of atmospheric air. Similarly, the fuel can take a variety of forms suitable for use in gas turbine engines. To set forth just a few non-limiting examples, the fuel can take the form of JP-4, JP-8, and Jet A, the fuel can be a blended fuel, and/or the fuel can include any number and type of additives.

Though the gas turbine engine 50 is depicted as having a single compressor and single turbine, in other embodiments the gas turbine engine 50 can have any number of compressors and turbines. In addition, the gas turbine engine 50 can have any number of shafts coupling the compressors and turbines to create separate spools. In a few non-limiting examples of embodiments, the gas turbine engine 50 can take the form of a turboshaft, turboprop, or turbofan engine. In addition, the gas turbine engine 50 can be an adaptive or variable cycle engine. In some forms the gas turbine engine 50 can be an axial flow engine, centrifugal flow engine, or a mixed axial-centrifugal flow engine. In short, the gas turbine engine 50 and/or it's individual components can take on a variety of forms and be used in a variety of applications.

In some applications the gas turbine engine 50 can be used as a powerplant for an aircraft. As used herein, the term "aircraft" includes, but is not limited to, helicopters, airplanes, unmanned space vehicles, fixed wing vehicles, variable wing vehicles, rotary wing vehicles, unmanned combat aerial vehicles, tailless aircraft, hover crafts, and other airborne and/or extraterrestrial (spacecraft) vehicles. Further, the present inventions are contemplated for utilization in other applications that may not be coupled with an aircraft such as, for example, industrial applications, power generation, pumping sets, naval propulsion, weapon systems, security systems, perimeter defense/security systems, and the like known to one of ordinary skill in the art.

Figure 2:
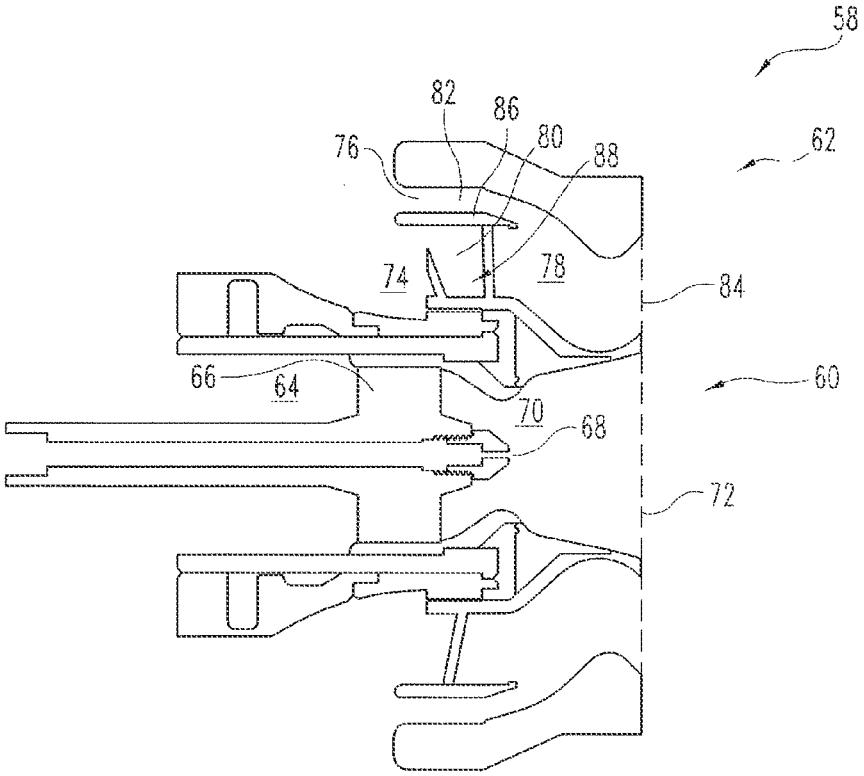
FIG. 2 depicts an embodiment of a fuel/air mixer.

Turning now to FIG. 2, a view of one embodiment of the fuel mixer 58 is shown. The fuel mixer 58 is used to atomize liquid fuel and mix the fuel with an air stream before being combusted in the combustor 54. In one form the fuel mixer 58 can be used to provide fuel to a lean burning combustor 54 of the gas turbine engine 50. Generally speaking, the rate of vaporization of a liquid fuel can be enhanced by increasing the total surface area of the liquid fuel in relation to the mass of fuel. For example, by forming the liquid fuel into droplets or forms other than a bulk liquid the rate of vaporization can be increased. Such increase in the surface area relative to its mass can be made possible by atomizing the fuel using a variety of approaches. The fuel mixer 58 of the present application uses plain jet airblast atomizers in some embodiments, in other embodiments the fuel mixer 58 can also include a pressure swirl mixer, and in others can also include fuel filming, some or all of which to be described in some form further below. It will be appreciated, however, that the mixer 58 is not limited to these particular approaches and can include additional and/or alternative forms.

In the illustrated form the fuel mixer 58 includes a pilot mixer 60 and a main mixer 62 both of which can be used to provide a mixture of fuel and air to the combustor 54. In one form the pilot mixer 60 includes a passage 64 through which an air traverses and a swirler 66 structured to change a direction of the air such as by adding a rotational component. The pilot mixer 60 can include a single annular passage 64 or multiple separate passages which can be arranged in an annular configuration, to set forth just a few non-limiting embodiments. Many different types of swirlers can be used in the pilot mixer 60 such as, but not limited to, vane type swirlers and swirlers formed of a plurality of discrete air passages arranged at an angle relative to the direction of incoming airflow.

The pilot mixer 60 also includes a fuel aperture 68 through which a fuel can be provided to the fuel mixer 58 at a variety of flow rates, pressures, and temperatures. In the illustrated embodiment the fuel aperture 68 is oriented to provide fuel along an axis of the fuel mixer 58, and in one non-limiting form the axis can be a central axis of the fuel mixer 58. In some embodiments the fuel aperture 68 can provide fuel to the pilot mixer 60 other than along the central axis of the fuel mixer 58. For example, in some forms fuel can be delivered off axis, while in other forms the fuel can be delivered at an angle relative to the central axis, to set forth just a few non-limiting possibilities. In one form the pilot mixer 60 can deliver fuel to be mixed with air using airblast atomization, but other approaches are also contemplated herein. Though the fuel mixer 58 is illustrated as having just a single fuel aperture 68, other embodiments of the mixer 58 can include one or more apertures 68.

An area change portion 70 is located between the swirlers 66 and an exit 72 of the pilot mixer 60. The area change portion 70 is used to accelerate the flow of air toward the exit 72 of the fuel mixer 58. In the illustrated embodiment the area change portion 70 includes a throat which denotes a minimum area of the area change portion 70. In some embodiments, including the illustrated embodiment, the area change portion 70 also includes a portion beyond the throat which increases in cross sectional area and causes a subsequent slowing of an air toward the exit 72. Though the swirlers 66 are depicted in the illustrated embodiment as extending to the area change portion 70, in other embodiments the swirlers 66 can extend into the area change portion and toward the exit 72 any variety of distances.

The fuel aperture 68 of the pilot mixer 60 is located near a throat of the area change portion 70 in the illustrated embodiment. In some forms the fuel aperture 68 can be located downstream of the throat, in other forms it is located at the throat, and in still further forms the fuel aperture 68 can be located upstream of the throat. In any event, any variety of spatial relationships are contemplated between the throat of the area change portion 70 and the fuel aperture 68.

Figure 3:
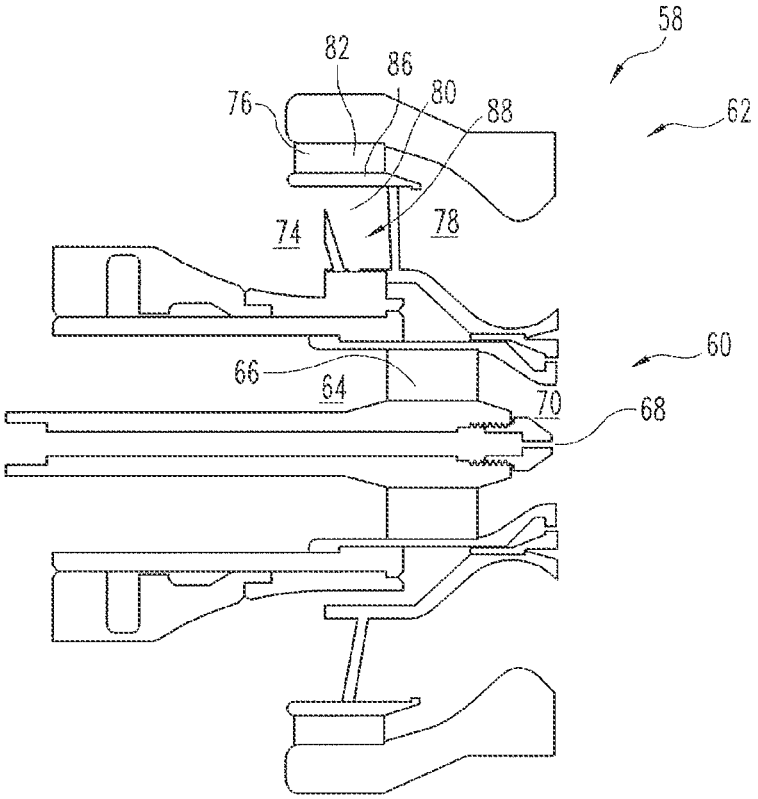
FIG. 3 depicts an embodiment of a fuel/air mixer.
Figure 4:
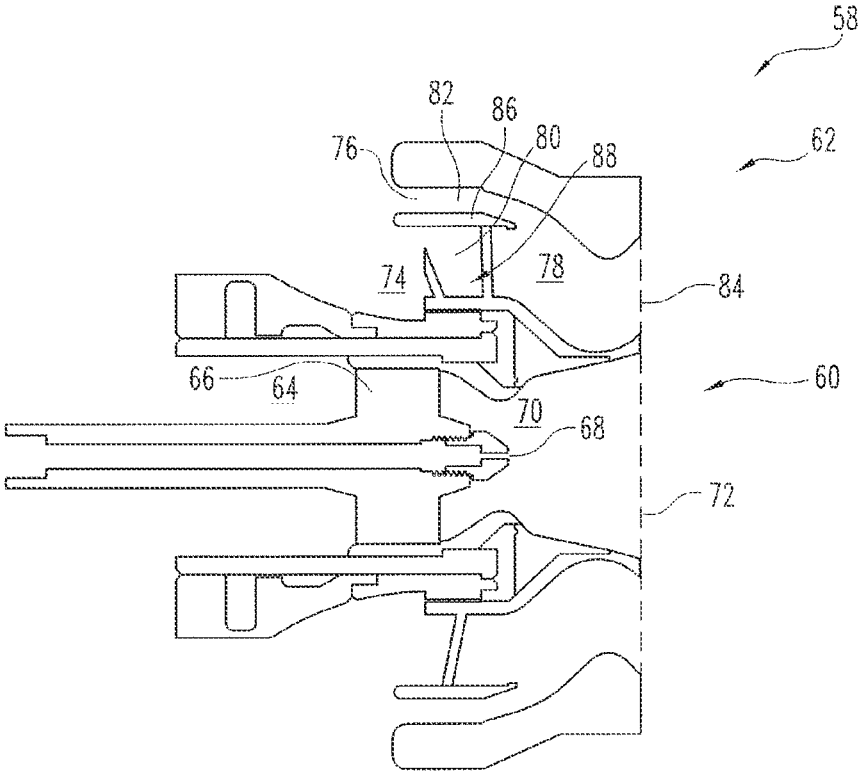
FIG. 4 depicts an embodiment of a fuel/air mixer.

The fuel aperture 68 is offset from the exit 72 of the pilot mixer 60 in the illustrated embodiment. The offset can vary from a relatively large amount to a relatively small amount. In some forms the offset can be negligible. Various offset configurations, passage shapes, and exit orientations, among others can be used, some of which are illustrated in FIGS. 2 and 3.

In the illustrated embodiment the main mixer 62 includes an inner passage 74 and an outer passage 76 both of which are combined into a main passage 78 downstream from each. The passages 74 and 76 are used to provide air to be mixed with fuel in the main mixer 62 The inner passage 74 can include a swirler 80 structured to change a direction of the air such as by adding a rotational component. The passage 74 can be a single annular passage or can take the form of multiple separate passages arranged in an annular configuration, to set forth just a few non-limiting embodiments. The outer passage 76 can additionally and/or alternatively include a swirler 82 structured to change a direction of the air such as by adding a rotational component. The passage 76 can be a single annular passage or can take the form of multiple separate passages arranged in an annular configuration, to set forth just a few non-limiting embodiments. Many different types of swirlers can be used in the main mixer 62 such as, but not limited to, vane type swirlers and swirlers formed of a plurality of discrete air passages arranged at an angle relative to the direction of incoming airflow. Furthermore, any of the swirlers 80 and 82, and for that matter swirlers 66, can have any configuration that is unique relative to each other. For example, swirler 66 can have a different geometry than either or both of swirlers 80 and 82. To set forth another non-limiting example, any of the swirlers can have a different number of passages arranged to change the direction of air traversing the swirlers. Some embodiments, however, can have similar or identical characteristics between the swirlers. Either or both of the swirlers 80 and 82 can extend toward an exit 84 of the main mixer 62 any variety of distances. To set forth just one non-limiting example in this regard, swirler 82 can extend to an end of the member 86 disposed between the inner passage 74 and outer passage 76.

In the illustrated form the main mixer 62 includes a fuel opening 88 arranged to provide fuel coincident with the swirler 80. The fuel opening 88 is positioned between an upstream side of the swirler 80 and a downstream side, but any position between the two is contemplated. Furthermore, though the fuel opening 68 is configured to provide a jet of fuel in a radially outward direction at this location, other embodiments can provide for delivery of fuel in any variety of other locations and orientations.

Depending on relative flow rates, pressures, etc of the fuel and air within the main mixer 62, in some embodiments and/or modes of operation the fuel emitted from the fuel opening 88 can form a fuel film on a surface of the member 86. For example, a fuel film can be developed upon the member 86 depending upon a power setting required of the gas turbine engine 50. As will be appreciated by a review of the figures, such a fuel filming surface is configured to deliver a film of fuel to the confluence of air from the inner passage 74 and the outer passage 76 of the illustrated embodiment.

The main passage 78 provides a common pathway for a mixture of fuel and air from the main mixer 62 to the exit 84 of the fuel mixer 58. In the illustrated embodiment the main passage 78 includes a converging portion which is used to accelerate the flow of air toward the exit 84. The illustrated embodiment also includes a diverging portion downstream of a minimum area of the main passage 78 forming a converging-diverging main passage 78. The diverging portion of the main passage 78 can be used to slow a flow of fuel/air mixture as it proceeds toward the exit 84. Not all embodiments of the main passage 78 need include either or both the converging-diverging portion.

As can be seen in the illustrated embodiment, the main passage 78 includes a portion that is turned radially inward toward the pilot mixer 60, as well as a portion that is turned radially outward away from the pilot mixer 60. Various embodiments of the main passage 78 can be configured to provide for either or both turning flow and changing a cross sectional area.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus comprising:

a main gas turbine fuel/air mixer having a first main swirler and a main fuel opening for a delivery of fuel to a first main passage, the main fuel opening positioned between an upstream side of the first main swirler and a downstream side of the first main swirler;

a main convergent-divergent portion downstream of the first main swirler, the main convergent-divergent portion configured to provide a space to mix a fuel from the main fuel opening with an air having a movement provided by the first main swirler; and a pilot mixer having a pilot swirler positioned upstream of a pilot fuel opening for a delivery of a fuel to the pilot mixer, the pilot mixer including a fuel aperture and an annular passage for passage of air that surrounds the fuel aperture, the pilot mixer including a pilot convergent-divergent portion that converges at a narrowest diameter of a throat thereof, wherein the pilot fuel opening through which the fuel exits is downstream of the narrowest diameter, and wherein all the air passing through the pilot mixer passes through the pilot swirler before entering the pilot convergent-divergent portion.

2. The apparatus of claim 1, wherein the main fuel opening is configured to deliver a jet of fuel transverse to a passing stream of air.

3. The apparatus of claim 2, wherein the first main passage includes a member positioned opposite the main fuel opening for forming a fuel film on a surface thereof.

4. The apparatus of claim 2, which further includes a second main passage radially offset from the first main passage, the second main passage including a second main swirler located upstream from the main convergent-divergent portion.

5. The apparatus of claim 1, which further includes a second main swirler radially outward of the first main swirler, and wherein the main fuel opening is located to provide fuel to the first main swirler, and wherein the pilot fuel opening is recessed from a pilot fuel/air mixture outlet.

6. The apparatus of claim 5, wherein the first main passage, a second main passage, and the main convergent-divergent portion are part of a main passage, and wherein a portion of an inlet of the main passage is radially outward of a portion of an outlet of the main passage.

7. The apparatus of claim 1, which further includes a second main passage having a second swirler, and wherein the pilot mixer includes the pilot convergent-divergent portion.

8. An apparatus comprising:

a gas turbine engine fuel module having a main mixer and a pressure swirl pilot mixer, the gas turbine engine fuel module including:

the pressure swirl pilot mixer having a pilot fuel opening structured to deliver fuel to a pilot passage that includes a swirler, the pilot mixer including a fuel aperture and an annular passage for passage of air that surrounds the fuel aperture, the pilot mixer including a pilot convergent-divergent portion that converges at a narrowest diameter of a throat thereof, wherein the pilot fuel opening through which the fuel exits is downstream of the narrowest diameter, and wherein all the air passing through the pilot mixer passes through the swirler before entering the pilot convergent-divergent portion; and the main mixer having a main flow path that includes a first flow path having a first swirler radially inward from a second flow path having a second swirler and both the first flow path and second flow path merge to a common flow path prior to a main mixer outlet, the main mixer also having a fuel opening positioned in the first flow path and structured to dispense a fuel upstream of the common flow path.

9. The apparatus of claim 8, which further includes a main mixer flow path downstream of both the first flow path and the second flow path, the main mixer flow path having a convergent section.

10. The apparatus of claim 9, wherein the convergent section is defined by an outer wall and an inner wall, each of the outer wall and inner wall having a decreasing radial distance from a central axis of the gas turbine engine fuel module along a length of the main mixer flow path.

11. The apparatus of claim 10, wherein the outer wall and inner wall are configured to provide for a divergent section downstream of the convergent section.

12. The apparatus of claim 8, wherein the fuel opening is oriented to provide a jet of fuel to the first flow path.

13. The apparatus of claim 8, wherein the first flow path includes a fuel filming surface to receive a jet of fuel from the fuel opening, and wherein the common flow path includes a convergent divergent section.

14. The apparatus of claim 13, wherein the pilot fuel opening of the pilot mixer is recessed from an outlet of the pilot mixer.

15. A method comprising:

delivering a pilot fuel to a pilot passage to form a pilot fuel/air mixture, the pilot passage including an annular passage having vanes for swirling a pilot air and including a fuel aperture and an annular passage for passage of air that surrounds the fuel aperture, the pilot mixer including a pilot convergent-divergent portion that converges at a narrowest diameter of a throat thereof, wherein the fuel aperture through which the fuel exits is downstream of the narrowest diameter, and wherein all the air passing through the pilot mixer passes through the vanes before entering the pilot convergent-divergent portion;

providing a main fuel to a first main passage located radially inward of a second main passage, the first main passage having a plurality of members oriented to impart a rotational component to a main air passing through the first main passage, the providing located between an upstream end of one of the plurality of members and a downstream end of the one of the plurality of members and oriented to eject fuel in a direction away from a central axis of the pilot passage;

mixing the main fuel with the main air in the first main passage; and turning a flow line of the mixture of main fuel and main air toward a pilot mixer in another passage located downstream of the providing the main fuel.

16. The method of claim 15, which further includes accelerating the mixture of main fuel and air in the another passage, the another passage having a converging flow area.

* * * * *